US006568152B1

(12) United States Patent
Schölzke

(10) Patent No.: US 6,568,152 B1
(45) Date of Patent: May 27, 2003

(54) PROCESS AND DEVICE FOR PACKAGING A MATERIAL WEB ROLL

(75) Inventor: Volker Schölzke, Krefeld (DE)

(73) Assignee: Voith Sulzer Papiertechnik Patent GmbH, Heidenheim (GB)

( * ) Notice: Subject to any disclaimer, the term of this patent is extended or adjusted under 35 U.S.C. 154(b) by 161 days.

(21) Appl. No.: 09/351,164

(22) Filed: Jul. 12, 1999

(30) Foreign Application Priority Data

Jul. 13, 1998 (DE) ..... 198 31 277

(51) Int. Cl.[7] ..... B65B 11/56

(52) U.S. Cl. ..... 53/399; 53/587; 53/214; 53/383.1

(58) Field of Search ..... 53/399, 465, 118, 53/211, 214, 587, 430

(56) References Cited

U.S. PATENT DOCUMENTS

| | | | | | |
|---|---|---|---|---|---|
| 2,938,319 | A | * | 5/1960 | Nystrand | 53/214 |
| 3,290,861 | A | * | 12/1966 | Prager | 53/214 |
| 3,412,524 | A | * | 11/1968 | Nestell | 53/212 |
| 3,494,095 | A | * | 2/1970 | Valvano | 53/214 |
| 4,546,875 | A | * | 10/1985 | Zweber | 53/214 |
| 4,765,464 | A | * | 8/1988 | Ristvedt | 53/214 |
| 5,768,858 | A | * | 6/1998 | Hannen | 53/465 |
| 5,974,768 | A | * | 11/1999 | Scholzke | 53/399 |

FOREIGN PATENT DOCUMENTS

| | | | | |
|---|---|---|---|---|
| DE | 1278327 | | 9/1968 | |
| DE | 4124064 | | 4/1993 | |
| DE | 4233521 | | 4/1994 | |
| DE | 19535746 | | 5/1998 | |
| DE | 19652449 | | 7/1998 | |
| GB | 750561 | * | 6/1956 | 53/214 |

* cited by examiner

*Primary Examiner*—John Sipos
(74) *Attorney, Agent, or Firm*—Greenblum & Bernstein, P.L.C.

(57) ABSTRACT

Process and device for packaging a material web roll. The device of the invention includes a packaging web dispenser, a holding device adapted to hold at least the beginning of a packaging web against the circumference of the material web roll, and a rotary drive for rotatably driving the material web roll. The holding device includes a pressure-sensitive adhesive dispenser and a pressing device. The process includes holding at least the beginning of the packaging web against the circumference of the material web roll, rotating the material web roll, and detachably bonding the packaging web to the circumference of the material web roll with the aid of a pressure-sensitive adhesive.

16 Claims, 1 Drawing Sheet

Fig.2a
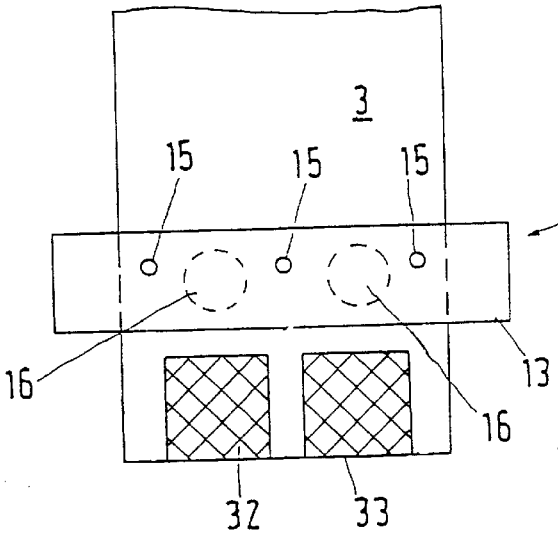
Fig.2 b
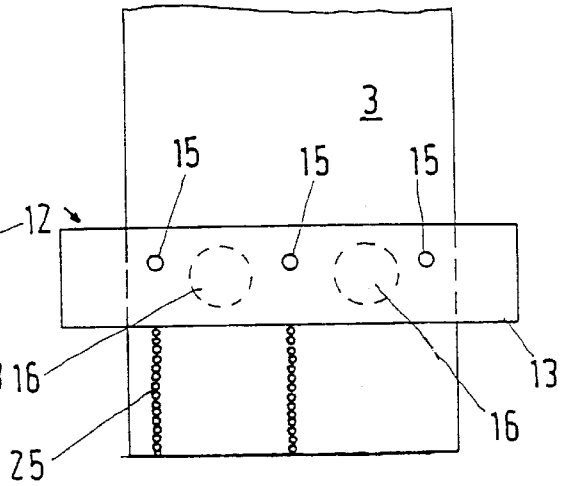
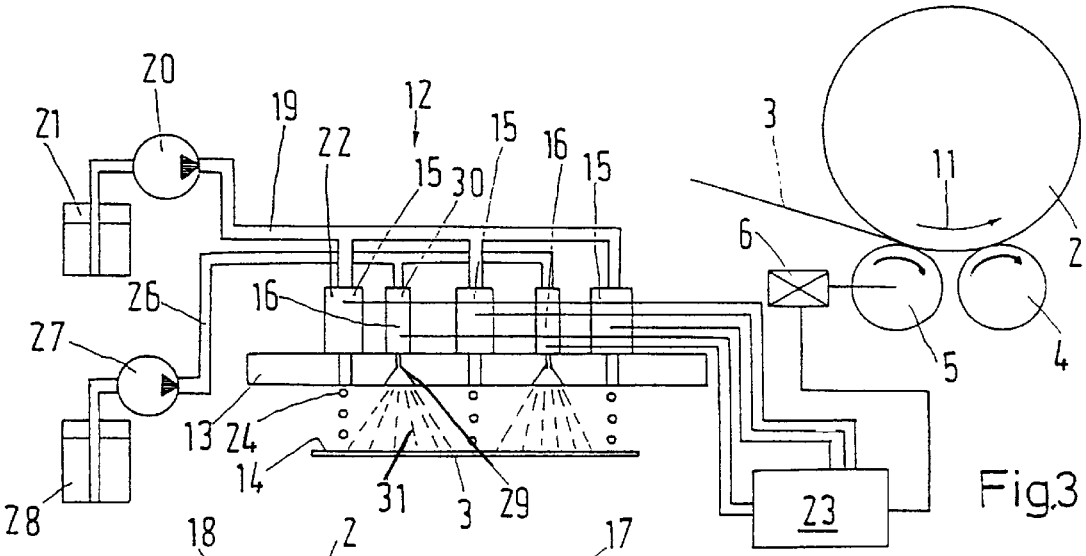
Fig.3
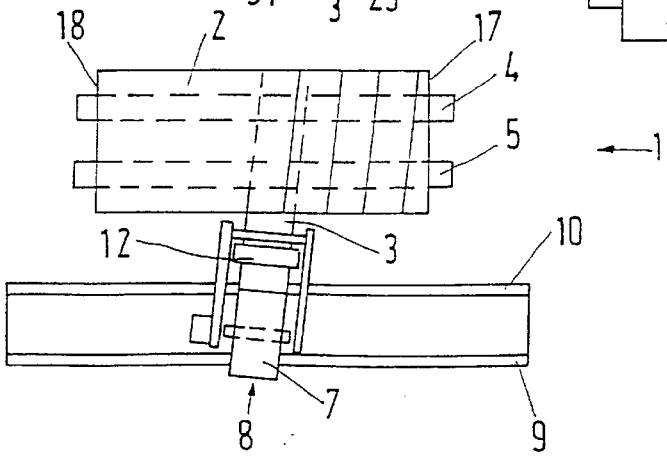
Fig.1

PROCESS AND DEVICE FOR PACKAGING A MATERIAL WEB ROLL

CROSS-REFERENCE TO RELATED APPLICATIONS

The present invention claims priority under 35 U.S.C. § 119 of German Patent Application No. 198 31 277.6, filed on Jul. 13, 1998, the disclosure of which is expressly incorporated by reference herein in its entirety.

BACKGROUND OF THE INVENTION

1. Field of the Invention

The invention relates to a process and device for packaging a material web roll, and more particularly to a process and device for holding a material web roll wherein at least the beginning of a packaging web is held against the circumference of the material web roll.

2. Discussion of Background Information

The invention is described below using a paper web roll as an example of a material web roll. In principle, however, it can also be used with other material web rolls, for example, with rolls of films of plastic or metal or with rolls of endless cardboard.

Material web rolls to be packaged are of considerable size, having a diameter generally in the range of about 500 to 2,100 mm. Roll width is customarily 500 to 3,800 mm or even greater. Material web rolls of this type are created, for example, in the production of paper or textiles. To enable the material web rolls to be transported from their production site, such as a paper mill, to the site where they will be used, such as a printing plant, they must be wrapped in a packaging web for protection. The packaging web provides protection against damage and is also intended to minimize the effect of environmental factors such as atmospheric humidity.

Bonding packaging web with the circumference of a material web roll by applying an adhesive substance between the packaging web and the material web roll is known. This procedure, however, may result in damage to the material web roll. Also, the outer layer of the material web roll is often damaged during unpacking of the material web roll. Further, underlying layers of the material web are also damaged during unpacking.

Therefore, to avoid adhesive bonding, the beginning of the packaging roll is wound around the circumference of the material web roll until the next layer of the packaging web holds the beginning firmly with sufficient tension. When the material web roll is then rotated further, the holding device can be stopped. The packaging is considered "self-locking," i.e., further layers of packaging web may be applied without the beginning of the packaging web slipping on the circumference of the material web roll, because this beginning is held firmly by the packaging web itself.

However, this procedure is relatively costly. The necessary winding and holding devices are relatively complicated and require additional floor space. Furthermore, this device increases the number of components in which failures can occur. Consequently, there is an increased risk of interruption of the packaging process.

SUMMARY OF THE INVENTION

The present invention provides a process and device for packaging a material web roll. The device of the invention includes a packaging web dispenser, a holding device adapted to hold at least the beginning of a packaging web against the circumference of the material web roll, and a rotary drive for rotatably driving the material web roll. The holding device includes a pressure-sensitive adhesive dispenser and a pressing device.

According to one feature of the invention, the pressure-sensitive adhesive dispenser is a spray device. The pressing device may include a nip between the material web roll and a driven roller. Further, the driven roller may be adapted to support the material web roll thereon.

The packaging web dispenser may be adapted to dispense the packaging web at a predetermined angle to the longitudinal axis of the material web roll.

The process for packaging a material web roll according to the present invention includes holding at least the beginning of a packaging web against the circumference of the material web roll, rotating the material web roll, and detachably bonding the packaging web to the circumference of the material web roll with the aid of a pressure-sensitive adhesive.

The process may further include applying the pressure-sensitive adhesive to the packaging web. Additionally, the process may include feeding the packaging web through at least one nip between the material web roll and a driven roller. Also, the material web roll may lie on the driven roller.

Further, the process may include successively winding a plurality of layers of the packaging web around the material web roll, and nondetachably binding each successive packaging web layer to the preceding wound packaging layer, using an adhesive that is not pressure-sensitive. The winding may be performed in a spiral.

The process may yet further include spraying the pressure-sensitive adhesive onto at least one of the packaging web and the material web roll.

The present invention packages a material web roll without damaging the surface thereof. The method of the invention does so by detachably bonding the packaging web with the circumference of the material web roll with the aid of a pressure-sensitive adhesive.

A pressure-sensitive adhesive that is suitable for this application is available, for example, under the product name "JOWATEX" from Jowat Lobers und Frank GmbH & Co. KG, Wittekindstrasse 19, D-32709 Detmold, Germany. The pressure-sensitive adhesive ensures a bond between at least the beginning of the packaging web, and the circumference of the material web roll. The pressure-sensitive adhesive has a bonding strength of 8 g/cm$^2$, more preferably 70 g/cm$^2$, and most preferably 75 g/cm$^2$. This bond is sufficiently stable to hold the beginning of the packaging web firmly on the circumference of the material web roll until a subsequent layer or band of the packaging web can exert additional forces on the layer forming the beginning, which takes place in a relatively short period of time (i.e., slightly more than one complete rotation of the material web roll). When the material web roll is to be unpacked, the wrapping formed by the packaging web is customarily destroyed. In contrast to previously known gluing processes, the packaging web can be peeled from the material web roll without leaving a residue. In addition to the material web roll being undamaged on its circumference, the disposal of the packaging is also improved. A homogeneous material is obtained that consists solely of the packaging web and contains no constituents of the material web roll. The packaging web customarily consists of packing paper. This packing paper is then unmixed with "white" paper of the material web roll or other materials that have been wound on the material web roll, which facilitates recycling of the packaging web material.

According to a certain feature of the invention, the pressure-sensitive adhesive is applied to the packaging web. The pressure-sensitive adhesive is applied shortly before the packaging web is bonded to the material web roll so that the pressure-sensitive adhesive first bonds with the packaging web and makes only its surface tacky. When the packaging web is peeled from the circumference of the material web roll, the pressure-sensitive adhesive remains on the packaging web and not on the circumference of the material web roll. The circumference of the material web roll remains clean and virtually free of residues.

According to another feature of the invention, the packaging web is fed through at least one nip between the material web roll and a driven roller. This nip presses the packaging web, which has been made tacky, against the circumference of the roller, which causes the packaging web to be bonded to the circumference of the material web roll with sufficient strength, although pressure-sensitive adhesives have lower holding power than hot or cold glue used previously in the art. Since the roller is driven, the packaging web is also driven by the roller, so that the bonding site between the beginning of the packaging web and the circumference of the material web roll is not stressed excessively by tensile forces. The packaging web is therefore "pulled along," at least at the beginning, not only by the rotation of the material web roll but also by the driven roller, which acts on the packaging web.

It is also advantageous for the material web roll to lie on the driven roller. The weight of the material web roll is then used to produce a certain pressure acting in the nip, making further measures unnecessary.

It is further advantageous for several layers of the packaging web to be wound around the material web roll, whereby each respective further exterior layer is nondetachably bonded to the layer or band below it, with a different adhesive. The term "nondetachably" refers to the situation that when the bond produced with this adhesive is separated, there is a risk of damaging at least one layer of the packaging web. In the present invention, two different adhesives may be used during packaging, namely, a first, pressure-sensitive, adhesive to produce the detachable "initial gluing," and a second, "normal," adhesive to produce the packaging about the body of the web roll. However, this arrangement saves the relatively complicated winding process for the beginning of the packaging web, so that any additional effort is readily justified. Because the layers of the packaging web are bonded permanently with one another, a very stable packaging is obtained, whereby it does not matter that the beginning of the packaging web has only a relatively weak adhesive bond to the circumference of the material web roll.

Advantageously, the packaging web may be wound around the material web roll in a spiral. In other words, the longitudinal edge of the packaging web has a predetermined angle to the longitudinal axis of the material web roll. This type of packaging process is known for example from German Patent Document No. DE 195 35 746 C2. With this type of packaging, it is virtually impossible, at a reasonable cost, to wind the beginning of the packaging web around the circumference of the material web roll until the next layer grips, to hold the beginning firmly. Therefore, the use of a pressure-sensitive adhesive is a good alternative if it is desired to avoid the beginning of the packaging web being permanently glued to the circumference of the material web roll.

Preferably, the pressure-sensitive adhesive is sprayed onto the packaging web. Spraying is advantageous in that the pressure-sensitive adhesive already acquires a relatively intensive contact with the air and thus with atmospheric oxygen during the application. Therefore, spraying ensures that the pressure-sensitive adhesive exhibits a high adhesiveness relatively fast, so that a sufficiently stable adhesive bond between the beginning of the packaging web and the circumference of the material web roll can be achieved in only a short time after the pressure-sensitive adhesive has been applied to the packaging web.

The holding device of the present invention includes a pressure-sensitive adhesive dispenser and a pressing device.

As with the process of the present invention, the holding device not only ensures that the pressure-sensitive adhesive is applied to the packaging web, and also ensures that the pressing device creates a sufficiently stable bond between the beginning of the packaging web and the circumference of the material web roll. When the pressing device has pressed the beginning of the packaging web against the circumference of the material web roll, a bond exists between the material web roll and the packaging web that is sufficient to wind the beginning of the packaging web far enough around the material web roll, because of the pressure-sensitive adhesive. This bond does not need to be durable or extremely stable; it merely replaces previously known holding methods.

The pressure-sensitive adhesive dispenser is preferably designed as a spray device. This pressure-sensitive adhesive may be sufficiently oxidized during the application to develop its adhesiveness.

The pressing device is preferably formed by a nip between the material web roll and a driven roller. After the area between the material web roll and the packaging web has been made tacky and has traveled through the nip, the driven roller of this nip serves to convey the packaging web further. The stress on the bonding site between the material web roll and the packaging web is correspondingly minimized.

Preferably, the material web roll lies on the roller. The weight of the material web roll is therefore used to press downward on the roller.

It is preferable for the packaging web dispenser to dispense the packaging web at a predetermined angle to the longitudinal axis of the material web roll. In this arrangement, the packaging web can be wound around the material web roll in a spiral. This is advantageous in that a single packaging web is sufficient, for example, a packaging web having a width of 500 mm, even with material web rolls having varied widths. Correspondingly, this arrangement facilitates the maintenance of the supply of the packaging web considerably. It is only necessary to keep packaging rolls of the same size (e.g., 500 mm wide), on hand. Normally, packaging in a spiral makes it more difficult to bond the beginning of the packaging web with the material web roll if permanent gluing is not used. However, the use of pressure-sensitive adhesive solves this problem.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein:

FIG. 1 shows a schematic top view of a packaging device according to the present invention;

FIG. 2*a* shows a schematic top view of a packaging web after it has passed through an adhesive application station at a first packaging stage;

FIG. 2*b* shows a schematic top view of a packaging web after it has passed through an adhesive application station at a second packaging stage; and FIG. 3 shows a schematic front view of the adhesive application station according to the present invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Referring to the drawings wherein like numerals represent like elements, FIG. 1 shows a device 1 for packaging a material web roll 2 with a packaging web 3. The material web roll 2 is carried on two carrying rollers 4, 5, carrying roller 5 being rotatable with the aid of a drive 6, as shown in FIG. 3. When the carrying roller 5 is rotated, the material web roll 2 also rotates. The packaging web 3 is fed through the nip between the carrying roller 5 and the material web roll 2.

The packaging web 3 is wound onto a supply roll 7 mounted on a packaging web dispenser 8. The packaging web dispenser can move on rails 9, 10 parallel to the longitudinal axis of the material web roll 3 (i.e., the axial direction). The angle of the dispenser to the material web roll 2 can also be adjusted. In the angle position shown in FIG. 1, the width direction of the packaging web 3 (i.e., the axial direction of the supply roll 7) forms an acute angle with the axial direction of the material web roll 2. Therefore, if the packaging web 3 is introduced between the material web roll 2 and the carrying roller 5 and is fixed to the material web roll 2, a spiral packaging of the material web roll 2 with the packaging web 3 is effected as the material web roll 2 is rotated in the direction of arrow 11, shown schematically in FIGS. 1 and 3.

The packaging web 3 has a considerably smaller width than the material web roll 2, for example, 500 mm, whereas the material web roll can accept widths up to about 3.8 m.

When the material web roll 2 rotates, the packaging web 3 is pulled along and winds itself onto the circumference of the material web roll 2 in a spiral. At least the beginning of the packaging web 3 must be held firmly on the circumference of the material web roll 2. The holding is only necessary until the material web roll 2 has traveled somewhat more than one rotation (i.e., slightly greater than 360°). At least part of the width of the packaging web 3 is covered by a subsequent rotation that then forms a second layer or band and that presses the packaging web 3 against the material web roll 2 (i.e., a slight overlap occurs between successive packaging web bands). It does no harm, of course, if the beginning of the packaging web 3 is also held firmly on the circumference of the material web roll 2 as the winding continues.

In order to hold the packaging web 3 to the material web roll 2, an adhesive application station 12 is provided, shown schematically in FIGS. 1 and 3. In FIG. 3, the packaging web 3 is shown twice for reasons of clarity, once below the adhesive application station 12 and once on the material web roll 2 to be packaged. This representation, in which the packaging web 3 can be seen once from the front and once from the side, was selected only for reasons of clarity. In practice, the packaging web 3 runs in a straight line from the adhesive application device 12 to the material web roll 2.

The adhesive application station 12 has a support 13 arranged above the packaging web 3. Thus, it is possible to provide the upper side 14 of the packaging web 3 with adhesive. This upper side then comes into contact with the material web roll 2 and is pressed against the material web roll 2 by the carrying rollers 5, 4.

The adhesive application station 12 has a first adhesive application device 16 and a second adhesive application device 15. The first adhesive application device 16 is connected via a line 26 and a pump 27 to a supply vessel 28. The first adhesive application device 16 has a plurality of valves 30 located upstream of respective spray nozzles 29. The valve 30 is opened upon activation of a control device 23, and a spray stream 31 is formed whereby adhesive reaches areas 32 on the upper side 14 of the packaging web 3, shown at a first packaging stage in FIG. 2*a*. The supply vessel 28 contains a specific adhesive substance, i.e., a pressure-sensitive adhesive. Such a pressure-sensitive adhesive is available, for example, from the German company Jowat Lobers und Frank GmbH & Co. KG, Wittekindstrasse 19, D-32709 Detmold, under the product name "JOWATEX". This adhesive is customarily suitable for the production of peel-off protective films and is based on a copolymer. This adhesive exhibits good cohesion and a low surface tackiness. The particular advantage of such a pressure-sensitive adhesive is that an adhesive bond formed with it can be readily and repeatedly detached without leaving a residue. If detachment is required, therefore, it is possible to peel the packaging web 3 from the circumference of the material web roll 2 again, without any residue remaining on the circumference of the material web roll 2. The pressure-sensitive adhesive remains solely on the packaging web 3, where it causes no problems.

As can be seen from FIG. 2*a,* the two areas 32 are flat. They extend over almost the entire width of the packaging web 3, with a certain distance being maintained from the edges in order to avoid soiling the surrounding areas. In the longitudinal direction (i.e., the direction of movement) of the packaging web 3, the areas 32 are relatively short (i.e. they stop shortly after the front edge 33 of the packaging web 3). However, they can also be so long that they correspond to the circumferential length of the material web roll 2, although this is not the rule.

Not only is flat adhesive application achieved by spraying the pressure-sensitive adhesive from the supply vessel 28, but high initial adhesiveness is also attained. This high adhesiveness is either due to the fact that the water content of the adhesive is lower after the spray application, or due to the fact that rapid oxidation of the adhesive takes place.

When the packaging web 3 is brought to a position against the material web roll 2, it already has a high initial adhesive strength as it travels through the first nip between the carrying roller 5 and the material web roll 2, and adhesive strength is further reinforced by the additional pressure applied by the carrying roller 4. It is usually sufficient when the area 32 has a length that corresponds to the distance between the two carrying rollers 4, 5. In certain cases the area 32 can be even shorter.

The adhesive bond effected with the aid of the pressure-sensitive adhesive from the supply vessel 28 does not need to be extremely stable. It need only be sufficient to hold the front edge 33 of the packaging web 3 on the circumference of the material web roll 2 until a subsequent layer or band covers the packaging web 3. The forces acting on the bond at this region are minimized because the carrying roller 5 is driven. The packaging web 3 is pulled by the roller 5 at a rate that corresponds to the circumferential velocity of the material web roll 2. Thus, there is no tensile stress on the pressure-sensitive adhesive site. The remaining forces, for instance, the force of gravity or centrifugal force, are so small that they can be overcome by the pressure-sensitive adhesive.

The second adhesive application device 15 is connected via a line 19 and a pump 20 to a supply vessel 21. The pump 20 withdraws adhesive, for example, a conventional cold glue, from the supply vessel 21 and conveys it under pressure through the line 19. The second adhesive application device 15 has valves 22 that can be opened and closed by the control device 23. The valves 22 deliver adhesive in the form of drops 24. The control device 23 is also connected with the drive 6 of the carrying roller 5. It therefore monitors the circumferential velocity of the material web roll 2, as well as the feed rate of the packaging web 3. The valves 22 are regulated so that the timing of the adhesive application varies depending upon the velocity of the packaging web 3. The valves 22 are regulated so that the adhesive application is constant per length unit of the packaging web 3 or at least remains in a predetermined target zone.

As can be seen from FIG. 2*b,* a succession of adhesive drops 24 form "glue caterpillars" 25, in a second packaging stage. The adhesive drops may touch each other, for example, when they are squashed flat as the packaging web 3 is laid on the material web roll 2. This is advantageous, but not mandatory. Two of the glue caterpillars 25 are as close to the edge of the packaging web 3 as possible. More than the three glue caterpillars 25 may also be used in alternative embodiments.

The two-part adhesive supply shown ensures that the areas 32 at the beginning of the packaging web 3 adhere reliably to the circumference of the material web roll 2. As soon as the material web roll 2 has traveled somewhat more than one complete rotation, the second adhesive application device 15 can be put into operation. This then ensures only that the subsequent packaging web layers can be adhered firmly to the respective underlying packaging web layers or bands, so that a firmly bonded packaging is formed that can be handled as a unit. It no longer matters if the areas 32 are to become detached at a later point because the tension exerted by the packaging web 3 on underlying layers or bands is sufficient to hold the packaging securely on the circumference of the material web roll 2.

As shown in FIG. 2*b,* although there are three distribution points for the glue caterpillars 25, only two glue caterpillars 25 are formed. The reason for this is because the packaging web 3, at least in the initial packaging of the material web roll 2, always lies with part of its width contacting the circumference of the material web roll 2 (i.e., on the material web to be packaged) where it is desirable to prevent a firm adhesion thereto. Therefore, the glue caterpillars 25 are only applied in areas where the packaging web 3 can lie on a previously applied packaging web layer or band. When the angle of the packaging web dispenser 8 is changed, for example, when a second material web roll is to be packaged after the packaging of a first material web roll 2 and the packaging web dispenser runs in an opposite direction, the inactive second adhesive application device 15 is then put into operation and thus the left second adhesive application device is stopped (as shown in FIG. 2*b*).

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for packaging a material web roll, the process comprising:

holding at least the beginning of a packaging web against the circumference of the material web roll;

rotating the material web roll; and detachably bonding the packaging web to the circumference of the material web roll with the aid of a pressure-sensitive adhesive.

2. The process according to claim 1, further comprising applying the pressure-sensitive adhesive to the packaging web.

3. The process according to claim 1, further comprising feeding the packaging web through at least one nip between the material web roll and a driven roller.

4. The process according to claim 3, wherein the material web roll lies on the driven roller.

5. The process according to claim 1, further comprising:

successively winding a plurality of layers of the packaging web around the material web roll; and nondetachably binding each successive packaging web layer to the preceding wound packaging layer, using an adhesive that is not pressure-sensitive.

6. The process according to claim 5, wherein said winding is performed in a spiral configuration.

7. The process according to claim 1, further comprising spraying the pressure-sensitive adhesive onto at least one of the packaging web and the material web roll.

8. A device for packaging a material web roll, comprising:

a packaging web dispenser;

a holding device adapted to hold at least the beginning of a packaging web against the circumference of the material web roll, said holding device comprising:

a) a pressure-sensitive adhesive dispenser; and b) a pressing device; and a rotary drive for rotatably driving the material web roll.

9. The device according to claim 8, wherein said pressure-sensitive adhesive dispenser is a spray device.

10. The device according to claim 8, wherein said pressing device comprises a nip between the material web roll and a driven roller.

11. The device according to claim 10, wherein said roller is adapted to support the material web roll thereon.

12. The device according to claim 8, wherein said packaging web dispenser is adapted to dispense the packaging web at a predetermined angle to the longitudinal axis of the material web roll.

13. The device according to claim 8, wherein the device is adapted to wind the packaging material about the material web roll in a spiral configuration.

14. The process according to claim 1, wherein the roll has a diameter between 500 mm to 2,100 mm and an axial length between 500 mm to 3,800 mm.

15. The process according to claim 1, wherein the pressure-sensitive adhesive has a specific bonding strength between 8 $g/cm^2$ and 15 $g/cm^2$.

16. The device according to claim 8, wherein the roll has a diameter between 500 mm to 2,100 mm and an axial length between 500 mm to 3,800 mm.

* * * * *